US008597329B2

(12) United States Patent
Du Chesne et al.

(10) Patent No.: US 8,597,329 B2
(45) Date of Patent: Dec. 3, 2013

(54) PACIFIER

(75) Inventors: Alexander Du Chesne, Heeslingen (DE); Guenter Marr, Rosengarten (DE); Helmut Tomforde, Brest (DE)

(73) Assignee: MAPA GmbH Gummi- und Plastikwerke (DE)

( * ) Notice: Subject to any disclaimer, the term of this patent is extended or adjusted under 35 U.S.C. 154(b) by 178 days.

(21) Appl. No.: 12/664,919

(22) PCT Filed: Feb. 13, 2008

(86) PCT No.: PCT/EP2008/001075
§ 371 (c)(1),
(2), (4) Date: Jul. 6, 2010

(87) PCT Pub. No.: WO2008/154968
PCT Pub. Date: Dec. 24, 2008

(65) Prior Publication Data

US 2010/0268276 A1 Oct. 21, 2010

(30) Foreign Application Priority Data

Jun. 19, 2007 (DE) ..... 10 2007 027 960

(51) Int. Cl.
*A61J 17/00* (2006.01)

(52) U.S. Cl.
USPC ..... 606/234; 606/235; 606/236; 215/11.1; 215/11.2; 215/11.3; 215/11.4; 215/11.5

(58) Field of Classification Search
USPC ..... 606/234; 215/11.1–11.6; 119/71, 709
See application file for complete search history.

(56) References Cited

U.S. PATENT DOCUMENTS

| | | | | |
|---|---|---|---|---|
| 2,672,870 | A | 1/1952 | Alstadt et al. | |
| 3,924,620 | A * | 12/1975 | Seunevel | 215/11.1 |
| 4,505,398 | A * | 3/1985 | Kesselring | 215/11.5 |
| 4,632,263 | A | 12/1986 | Gerzman | |
| 4,834,099 | A | 5/1989 | Schrooten | |
| 5,598,809 | A * | 2/1997 | McInnes | 119/71 |
| 6,241,110 | B1 | 6/2001 | Hakim | |
| 2004/0220618 | A1* | 11/2004 | Rohrig | 606/234 |

FOREIGN PATENT DOCUMENTS

| | | | |
|---|---|---|---|
| DE | 7736290 | U | 3/1978 |
| DE | 7916554 | U1 | 9/1979 |
| DE | 9415655 | U1 | 9/1994 |
| DE | 69011152 | T2 | 1/1995 |
| EP | 0384394 | A2 | 8/1990 |
| EP | 1652506 | A1 | 5/2006 |
| GB | 621245 | A | 4/1949 |
| GB | 882007 | A | 11/1961 |

* cited by examiner

*Primary Examiner* — Katherine Dowe
*Assistant Examiner* — Sidharth Kapoor
(74) *Attorney, Agent, or Firm* — Hiscock & Barclay, LLP

(57) ABSTRACT

A dummy teat including a nipple carrier and a hollow dummy nipple projecting from the nipple carrier, which has areas of a smaller wall thickness at least on two opposed longitudinal sides.

16 Claims, 4 Drawing Sheets

PACIFIER

CROSS REFERENCE TO RELATED APPLICATIONS

This application is a national phase application of PCT/EP2008/001075, filed Feb. 13, 2008 entitled: PACIFIER, which is based upon German Patent Application No. 10 2007 027 960.6, filed Jun. 19, 2007 entitled: A DUMMY TEAT. The entire contents of each of the above noted applications are herein incorporated by reference.

FIELD OF THE INVENTION

The invention relates to a dummy teat, specifically for use by babies or infants.

BACKGROUND OF THE INVENTION

Dummy teats which include a nipple carrier and a hollow dummy nipple projecting from the nipple carrier have been known from DE 94 15 655 U1, for example. In a nursing dummy teat, the nipple carrier is a mouthpiece which can be fixed, by the edge of an aperture, to the border of a nursing bottle aperture. The teat nipple has a hole for being nursed on a mouthpiece or nipple head and the mouthpiece has an aeration valve at a distance from the edge of the aperture. A pacifying dummy teat can do without a hole for being nursed and an aeration valve. The nipple carrier is a mouth shield which is supported by the lip area, thus preventing the baby from swallowing the pacifying dummy teat. Further known are pacifying dummies with a handle at the outside of the mouth shield, e.g. a knob or swinging retaining ring.

Long-time sucking at the thumb or at too hard or thick a dummy nipple can lead to abnormal positions of the baby's dentition. Dummy teats are known already in which this risk is diminished very much by a dummy nipple which is very thin and particularly soft.

SUMMARY OF THE INVENTION

Accordingly, it is the object of the invention to provide a dummy teat which even more reduces the risk of abnormal positions of the baby's dentition.

The inventive dummy teat has a nipple carrier and a hollow dummy nipple projecting from the nipple carrier, which has areas of a smaller wall thickness on at least two opposed longitudinal sides.

In conventional dummy teats, a general reduction in the thickness of the dummy nipple would be less appropriate to further reduce the risk of abnormal positions of the dentition because this would imply a reduction of the overall dummy teat deformation perceived during sucking so that the dummy teat would no longer take sufficient account of a baby's natural need for sucking. The possible use of a softer material or one having a smaller wall thickness would lower product safety.

The inventive dummy teat clearly is more flexible on the two longitudinal sides because of the areas of a smaller wall thickness (hereinafter also referred to as "reduced-thickness zones") and, if used, therefore exerts less pressure onto the jaw-bone without the overall dummy teat deformation perceived undergoing a substantial change. As a result, account is taken of the babies' natural need for sucking and the risk of abnormal positions of the dentition is further reduced on the grounds that the local pressure loads on the jaw-bone are further diminished. Likewise, the reduced-thickness zones make it easier for the dummy nipple to temporarily snap down (as a so-called "kinking" deformation), which loads the jaw-bone particularly intensely in conventional dummy teats. Since the smaller wall thickness is limited to areas of the dummy nipple and the remaining areas are areas of a larger wall thickness (hereinafter also referred to as "enlarged-thickness zones") a mechanical weakening of the dummy nipple will basically not occur. Admittedly, it is expected that material fatigues in the areas of a smaller wall thickness will present themselves earlier than those in the areas of a larger wall thickness of the dummy nipple. However, those will lead to easily identifiable longitudinal cleavages of the dummy nipple before parts thereof can be torn off. Since material fatigues can be recognized better it is possible to see and substitute defective dummy teats in a better way. Further, cracks formed on the dummy nipple can be "caught" by the reduced-thickness areas and can intentionally be reversed in the direction of stretch of the reduced-thickness areas so that an easily recognizable longitudinal cleavage arises on the dummy nipple before any parts are torn off.

The nipple carrier is configured as a mouthpiece in a nursing dummy teat and the nipple carrier is configured as a mouth shield in a pacifying dummy teat.

Areas of a smaller wall thickness can be produced in different manners. According to an aspect, the dummy nipple, in areas of a convex cross-section with a smaller wall thickness, has a curvature which is more intense in the cross-section inside than in the cross-section outside. According to another aspect, the dummy nipple, in areas of a convex cross-section of a smaller wall thickness, has a corner in the cross-section inside and a curvature or corner having a larger aperture angle in the cross-section outside than in the cross-section inside.

The invention incorporates possible aspects in which the dummy nipple is concave in cross-section in areas of a smaller wall thickness. According to an aspect, the nipple then has a smaller curvature in the cross-section inside than in the cross-section outside. According to a further aspect, the dummy nipple, in areas of concave cross-section of a smaller wall thickness, has a corner in the cross-section outside and a curvature or corner having a larger aperture angle in the cross-section outside than in the cross-section inside.

According to another aspect, the dummy nipple, in areas of a smaller wall thickness, has contours running in parallel in the cross-section inside and outside and, furthermore, has areas of a wall thickness which is larger or becomes larger with an increasing distance from the areas of a smaller wall thickness.

Preferably, the dummy nipple is externally smooth in the areas of a smaller wall thickness and, selectively, in adjacent areas to prevent it from giving the baby an unpleasant feeling while it sucks.

Areas of a larger wall thickness may be produced in different manners. In the areas of a larger wall thickness, the dummy nipple may be limited in the cross-section inside and outside by curvatures and/or corners and/or straight lines, e.g. by two parallel lines between which the wall thickness is larger than in the areas of a smaller wall thickness. According to further examples, areas of a larger wall thickness in cross-section are limited by two curvatures or corners facing away from each other. Further, it is possible that the dummy teat will exhibit additional thicker areas or projections in areas of a larger wall thickness.

According to another aspect, the dummy nipple has at least one projection in the cross-section outside in areas of a larger wall thickness. According to an aspect, the dummy nipple has at least one projection in the cross-section inside in areas of a larger wall thickness. In this aspect, the dummy nipple can be externally smooth in the cross-section outside. The baby is not given an unpleasant feeling notwithstanding the mechanical reinforcement of the dummy nipple. According to a further aspect, the dummy nipple has projections offset from each other in the cross-section inside on opposed sides so as to avoid projections meeting with each other in squeezing the dummy teat and the dummy teat can be squeezed very much despite the enlarged-thickness zones crosswise thereto on opposed sides.

It is generally possible that the dummy teat is of a rotationally symmetric design about the longitudinal axis of the dummy nipple so that it can initially be introduced into the mouth in a random rotational position. Because of the areas of a smaller wall thickness, the dummy teat has a preferred position in a case that the areas of a smaller wall thickness are disposed in a transversal plane inside the mouth. The dummy nipple will then apply the least pressure to the baby's jawbone. The assumption is that the baby has, or promotes, a propensity for turning the dummy teat to this rotational position.

According to an aspect, the dummy teat has further configuration features by which a preferred rotational position is predetermined in the mouth. To this end, for example, the dummy nipple of a nursing dummy or pacifying dummy teat has a flat cross-section preferably disposed transversally inside the mouth and/or a widened nipple head with a flattened zone inclined towards the nipple axis to bear on the tongue as is described, for example, in DE 94 15 655 U1 (a so-called "NUK shape"). Furthermore, to this end, the mouth shield of a pacifying dummy teat can have a contour (e.g. an oval or butterfly-shaped one) with a clearance for the nasal zone. For this purpose, the inside of the mouth shield can also be domed such that the mouth shield has a preferred orientation towards the baby's lips. According to an aspect, in a dummy teat having more configuration features for a preferred orientation inside the mouth of the baby, the two opposed longitudinal sides are arranged to have areas of a smaller wall thickness with regard to the further configuration features such as to be in a preferred orientation transversally inside the baby's mouth when in use.

The dummy nipple can be of different configurations. For example, it may be round as a circle at least in one axial portion in cross-section outside. According to an aspect, the dummy nipple is oval at least in one axial portion in the cross-section outside. This particular dummy nipple having a flat cross-section has a preferred orientation in which the large axis of the oval circumscribing the cross-section outside is arranged transversally inside the baby's mouth. According to a further aspect, the dummy nipple has the two opposed areas of a smaller wall thickness on the two longitudinal sides on the large axis of the oval circumscribing the cross-section of the dummy nipple outside.

The dummy nipple, in addition to the two areas of a smaller wall thickness on two opposed longitudinal sides, can present at least one further longitudinally-sided area of a smaller wall thickness. According to a further aspect, more areas of a smaller wall thickness are disposed symmetrically to the small axis and/or large axis of the oval between the large axis and the small axis of the oval circumscribing the cross-section of the dummy nipple outside. The further areas of a smaller wall thickness will further diminish the pressure onto the jaw-bones while the dummy nipple is being squeezed. The provision of several areas of a smaller wall thickness on either side of the oval's small axis, while less intensely reducing the wall thicknesses on the reduced-thickness zones, makes it possible to achieve the same reduction in the pressure acting onto the jaw-bones as in a dummy nipple which only has two areas smaller in wall thickness. This can reduce the risk of dummy nipple failure.

According to an aspect, areas of a larger wall thickness are disposed on the two opposed longitudinal sides of the dummy nipple which, when in use, are arranged in a frontal plane of the mouth. According to a further aspect, the areas of a larger wall thickness are disposed on the two longitudinal sides on the small axis of an oval externally circumscribing the cross-section of the dummy nipple. With this arrangement, the areas of a larger wall thickness only put up a low resistance to the squeeze of the dummy nipple in the frontal plane. When the dummy nipple has been squeezed to a maximum the areas of a larger wall thickness will counteract a severance by the baby's teeth.

According to a further aspect, the areas of a smaller wall thickness and/or areas of a larger wall thickness are extended in a longitudinal direction of a hollow nipple shank of the dummy nipple and/or a hollow nipple head of the dummy nipple at least across one portion of the nipple shank and/or nipple head. According to a further aspect, the areas of a smaller wall thickness and/or areas of a larger wall thickness substantially extend over the full length of the nipple shank. According to a further aspect, the portions of a smaller wall thickness and/or portions of a larger wall thickness substantially extend over the full length of the hollow nipple head.

Various soft, flexible materials may be used for the dummy nipple. According to an aspect, the dummy nipple is manufactured from latex or silicone or polyisoprene (PI), other cross-linked elastomers or thermoplastic elastomers (TPE).

Hard, flexible materials are particularly usable for the mouth shield. According to an aspect, the mouth shield is made of a thermoplastic material or cross-linked or thermoplastic elastomers. According to an aspect, the mouth shield is made of polypropylene.

BRIEF DESCRIPTION OF THE DRAWINGS

The invention will be described below with reference to the accompanying drawings of embodiments. In the drawings.

DESCRIPTION OF THE INVENTION

In the following description of various embodiments, features which coincide or substantially coincide are designated by the same reference numbers, deviating designs being indicated by raised indexes.

Figure 1:
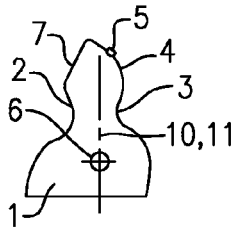
FIG. 1 shows a nursing bottle dummy teat with reduced-thickness zones on the longitudinal sides in a side view.
Figure 2:
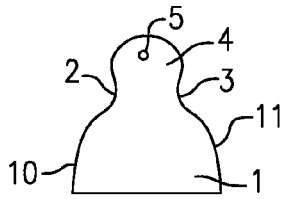
FIG. 2 shows the same nursing bottle dummy teat in a front view.
Figure 3:
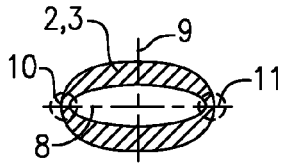
FIG. 3 shows the same dummy nipple of the same nursing bottle dummy teat in a cross-section.

In FIGS. 1 to 3, a nursing dummy teat has a nipple carrier in the shape of a hollow, cylindrical mouthpiece 1 to be put over the neck of a bottle. The mouthpiece 1 carries a hollow dummy nipple 2 of an orthodontic shape, which is oval in cross-section outside and is essentially oval inside. The dummy nipple 2 has a nipple shank 3 and a widened nipple head 4 with a nursing hole 5. The mouthpiece 1 has a valve 6 for pressure equalization.

The nipple head 4 approximately is in the shape of an ellipsoid and, on one side, is provided with a flattened zone 7 which is inclined at an acute angle to the centre axis of the dummy nipple 2 that is vertical in the drawing.

The oval externally surrounding the cross-section of the dummy nipple 2 has a large axis 8 and a small axis 9. On the two longitudinal sides which are crossed by the large axis 8 of the oval, the dummy nipple 2 has longitudinally running areas of a smaller wall thickness 10, 11 which extend through the nipple shank 3 and nipple head 4. Those areas of a smaller wall thickness 10, 11 continue from the nipple shank 3 in the same plane in the mouthpiece 1. In those areas 10, 11, the dummy nipple 2 always is curved continually in the cross-section outside and has a corner each in the cross-section inside.

Figure 4:
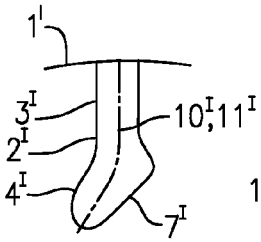
FIG. 4 shows a pacifying dummy teat having reduced-thickness zones on the longitudinal sides in a side view.
Figure 5:
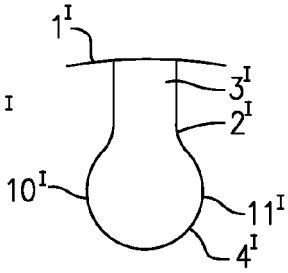
FIG. 5 shows the same pacifying dummy teat in a front view.
Figure 6:
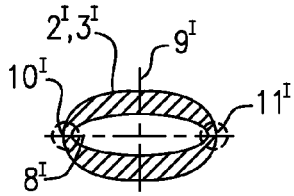
FIG. 6 shows the dummy nipple of the same pacifying dummy teat in a cross-section.

In FIGS. 4 to 6, a pacifying dummy teat has a nipple carrier in the shape of a mouth shield 1'. A dummy nipple 2' projects from the inside of the mouth shield 1'.

The dummy nipple 2' also is oval in its cross-section outside and substantially oval inside. The nipple head 4' also is provided with a flattened zone 7'. The dummy nipple 2' also is provided with areas of a smaller wall thickness 10', 11' that run longitudinally, on the two opposed longitudinal sides which are crossed by the large axis 8' of the oval surrounding the cross-section externally. The areas of a smaller wall thickness 10', 11' extend inside the nipple shank 3' in parallel with the center axis of the nipple shank 3' and are curved away from the center axis and flattened zone 7' in the nipple head 4'. In those areas 10', 11', the dummy nipple 2' always is curved continually in its cross-section outside and has a corner each in its cross-section inside.

Because of their configurations, the nursing dummy teat and the pacifying dummy teat are arranged each in a way that the long axis 8, 8' is disposed in the transverse plane of the mouth and the flattened zone 7, 7' bears on the baby's tongue. The dummy nipple 2, 2' puts up a lower resistance to a squeeze in the direction of the short axis 9, 9' than does a dummy nipple whose wall thickness is constant everywhere. This is owing to the areas of a smaller wall thickness 10, 11, 10', 11. As a consequence, this even more reduces the risk of an abnormal position of a baby's dentition.

Figure 7:
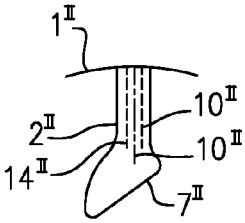
FIG. 7 shows a pacifying dummy teat having several longitudinally extending, reduced-thickness zones in a side view.
Figure 8:
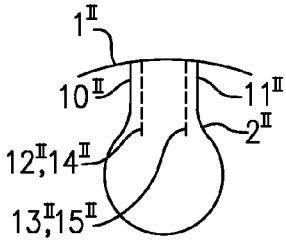
FIG. 8 shows the same pacifying dummy teat in a front view.
Figure 9:
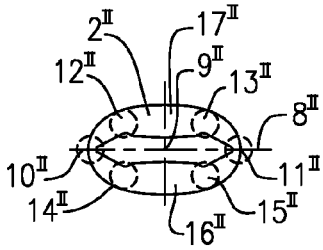
FIG. 9 shows a dummy nipple of the same pacifying dummy teat in a cross-section.

In the pacifying dummy teat of FIGS. 7 to 9, the dummy nipple 2", apart from having the areas of a smaller wall thickness 10, 11, exhibits more areas of a smaller wall thickness 12", 13", 14", 15" which are arranged between the large axis 8" and the small axis 9" of the oval externally surrounding the cross-section, those areas of a smaller wall thickness 12", 13", 14", 15" being disposed symmetrically with the two mentioned axes 8", 9".

Further, the dummy nipple 2" has longitudinally running areas of a larger wall thickness 16", 17" (also referred to as "enlarged-thickness zones") on the two opposed longitudinal sides which are crossed by the small axis 9'. In those areas 16", 17", the outer circumference always is curved continually and the inner circumference has a projection. On squeezing the dummy nipple in the direction of the small axis 9", the enlarged-thickness zones will finally bear on each other and prevent an excessive deformation.

Figure 10:
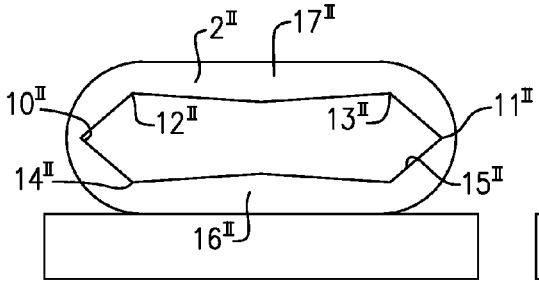
FIG. 10 shows the dummy nipple of the same pacifying dummy teat, when under no load, in an enlarged cross-section.
Figure 11:
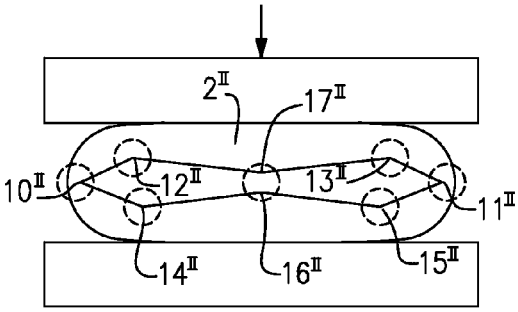
FIG. 11 shows the dummy nipple of the same pacifying dummy teat, when under a load, in a cross-section.

FIGS. 10 and 11 depict stresses in both the non-deformed and deformed cross-sections of the dummy nipple 2" where the stress is the larger the brighter is the colour of the cross-section. In FIG. 10, the non-loaded dummy nipple 2" is free from stresses at any point. In FIG. 11, stresses increase in the direction of the areas of a smaller wall thickness 10", 11", 12", 13", 14", 15" in the dummy nipple 2" loaded by the force F, such stresses being altogether moderate, however.

Figure 12:
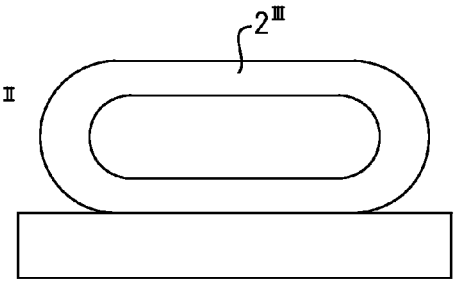
FIG.12 Prior Art
FIG. 12 shows the dummy nipple of a conventional pacifying dummy teat, when under no load, in a cross-section.
Figure 13:
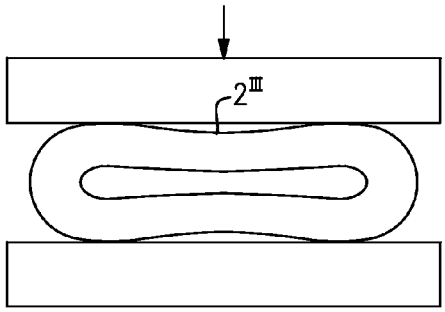
FIG.13 Prior Art
FIG. 13 shows the dummy nipple of the same pacifying dummy teat, when under a load, in a cross-section.

This becomes evident in a comparison with a conventional dummy nipple 2''' of a constant wall thickness which is shown under no load in FIG. 12 and as loaded by the force F in FIG. 13. In FIG. 13, the loaded areas extend across the entire longitudinal sides of the dummy nipple 2'''.

Figures 14A, 14B, 14C, 14D, 14E, 14F, 14G:
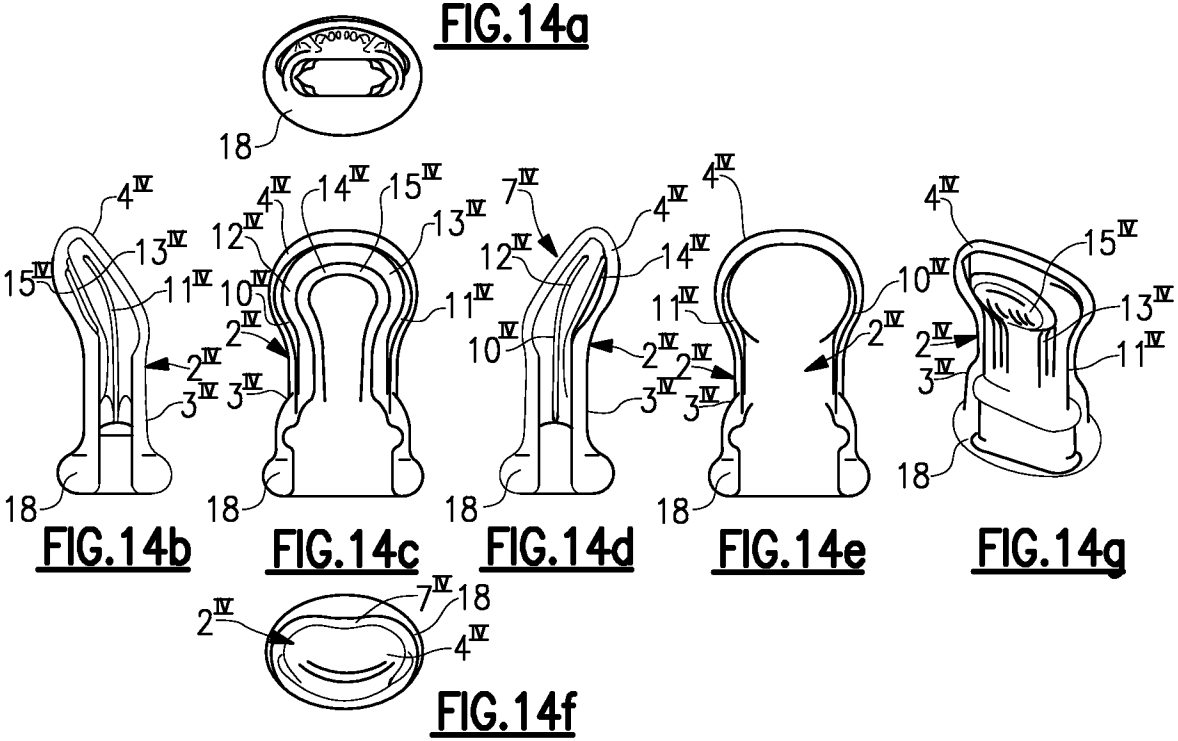
FIG. 14 shows a dummy nipple of a pacifying dummy teat having several longitudinally extending reduced-thickness zones in the nipple shank and nipple head, in the main views (FIGS. 14*a* to 14*f*) and in a perspective view (FIG. 14*g*).

FIG. 14 shows a dummy nipple $\mathbf{2}^{IV}$, which differs from the dummy nipple 2" of FIGS. 7 to 9 specifically in that the areas of a smaller wall thickness $\mathbf{10}^{IV}$, $\mathbf{11}^{IV}$ are disposed approximately on the middle plane of the nipple shank $\mathbf{3}^{IV}$ and extend far into the nipple head $\mathbf{4}^{IV}$ where they are curved away from the middle plane of the nipple shank $\mathbf{3}^{IV}$ so that they terminate in the vicinity of the outer end of a flattened zone or concavity $\mathbf{7}^{IV}$ at the underside of the nipple head $\mathbf{4}^{IV}$.

The areas of a smaller wall thickness $\mathbf{12}^{IV}$, $\mathbf{13}^{IV}$ start at a larger distance from the mounting end of the nipple shank $\mathbf{3}^{IV}$ than do the areas $\mathbf{10}^{IV}$, $\mathbf{11}^{IV}$, and also run initially in parallel with the middle plane of the nipple shank $\mathbf{3}^{IV}$. They are curved away from the middle plane in the nipple head $\mathbf{4}^{IV}$ and are joined to each other in the upper final area of the nipple head.

The areas of a smaller wall thickness $\mathbf{14}^{IV}$, $\mathbf{15}^{IV}$ extend at an even larger distance from the middle plane of the nipple shank $\mathbf{3}^{IV}$ approximately in parallel with the areas of a smaller wall thickness $\mathbf{12}^{IV}$, $\mathbf{13}^{IV}$.

In the areas $\mathbf{10}^{IV}$ to $\mathbf{15}^{IV}$, the dummy nipple always is curved continually in its cross-section outside and, in its cross-section inside, always has a corner or more intense curvature than it has outside.

The mounting end of the nipple shank $\mathbf{3}^{IV}$ is equipped with a dummy teat flange 18 which can be fixed to a side facing away from the user, of a mouth shield which is not shown, by means of devices which are not shown either.

Because of the areas of a smaller cross-section, the construction of the dummy nipple $\mathbf{2}^{IV}$ in the area of nipple shank $\mathbf{3}^{IV}$ and nipple head $\mathbf{4}^{IV}$ was configured as being particularly elastic in order to achieve a maximum softness possible.

As a result, the nipple shank $\mathbf{3}^{IV}$ only puts up a low resistance to a vertical load or a squeeze in the frontal plane on closing the mouth. The lateral reduced-thickness zones $\mathbf{10}^{IV}$ to $\mathbf{15}^{IV}$ allow the shank geometry to kink to a slight extent. If the load increases the cross-section will keep on being compressed until the nipple shank $\mathbf{3}^{IV}$ assumes the smallest height with the opposed sides bearing on each other.

In order to achieve the largest softness possible also within the area of the nipple head $\mathbf{4}^{IV}$, the areas of a smaller wall thickness $\mathbf{10}^{IV}$ to $\mathbf{15}^{IV}$ are led on into the area of the nipple head $4^{IV}$, as a result of which the resistance of the nipple head $4^{IV}$ is reduced while the baby is sucking. The deformation of the nipple head $4^{IV}$ is made easier by a controlled kinking in the areas of a smaller wall thickness $10^{IV}$ to $15^{IV}$.

Figure 15:
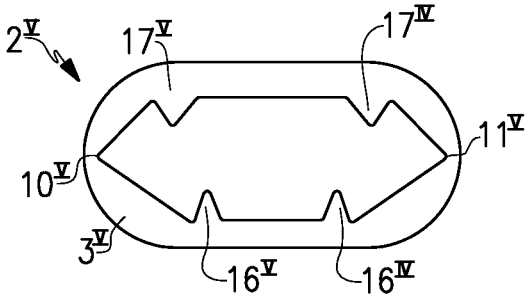
FIG. 15 shows a nipple shank of another dummy nipple of a pacifying dummy teat in a cross-section.

It is also possible to design the dummy nipple of a nursing dummy teat $2^{IV}$ in the way of the dummy nipple $2^{IV}$ of FIGS. 14 and 15. The invention incorporates such aspects of nursing dummy teats.

The dummy nipple $2^{V}$ of FIG. 15 differs from the dummy nipple 2" of FIGS. 7 to 9 essentially in that it has two projections $16^{V}$, $16^{VI}$, $17^{V}$, $17^{VI}$ each in the cross-section inside on the two substantially flat longitudinal sides of the dummy teat shank $3^{V}$. The projections $16^{V}$ and $17^{V}$ are laterally offset from each other and the projections $16^{VI}$, $17^{VI}$ are laterally offset from each other as well. As a consequence, they will not meet with each other while the nipple shank $3^{V}$ is squeezed in the frontal plane and the mouth is being closed so that excessively enlarged-thickness zones of the pacifying dummy teat are avoided.

The reduced-thickness zones may be achieved by using dip moulds with worked-in edges, which are more or less sharp and have a small radius of curvature, during the manufacture of the dummy teat in the dipping process (from dispersions, e.g. lattices or liquefied polymers such as solutions or melts). The fact that a thinner film will form on the more or less sharp edges of the dip moulds is an effect of the surface tension of the dipped material. The minimization of the free surface energy is achieved here by the latex film flowing away from convex surfaces towards less curved, planar or concave surfaces so that the film forms a uniform bow in cross-section over the more or less sharp edges of the mould. In addition to beveling the dip moulds which otherwise are rounded in diameter, an appropriate effect can also be attained, and possibly intensified, by working out an edge which then protrudes from the dip mould.

Conversely, the dummy teat material can intentionally be thickened according to the same principle by working concave areas into the dip mould. The principle is the same as that described previously: The film fills the concave areas of the mould and forms a uniform bow outside. Thus, thinner and reinforced areas can be obtained in the dummy teat in a combined variant of manufacture.

The effect described is additionally enhanced in heat-sensitive dipping by the fact that the heat potential of the mould naturally is exhausted earlier at the concave points than on straight or concave surfaces where coagulation consequently may take place for a prolonged period of time. Also in the salt coagulation technique, the available salt concentration per volume of a mix to be coagulated is distinctly lower at convex points than at planar or concave ones. Thus, the dipping techniques mentioned are equally suited to produce appropriate dummy teat geometries.

If mould shaping is performed by injection-moulding or compression-moulding the reduced-thickness and enlarged-thickness zones can be realized in the usual way for the current materials of solid rubber, thermoplastic elastomers, and solid or liquid silicone rubber. For example, this is done by working out suitable points in the mould, particularly on the core, if the outer contour is not to be altered. Accordingly, for example, the core is provided with more or less sharply protruding edges in areas on which a smaller wall thickness of the dummy teat is to be formed. Where areas of the dummy teat are to be formed in a larger wall thickness the core has concave areas. A die which has an inner contour matching with the outer contour of the dummy teat is disposed around the core. The die has a smooth inner contour, for example. It comprises outer jaws between which there is a separating plane. Moving the outer jaws apart perpendicularly to the separating plane allows to open the die after the dummy teat is injection-moulded, which can then be removed from the core.

While the present invention has been explained with reference to the structure disclosed herein, it is not confined to the details set forth and this invention is intended to cover any modifications and changes as may come within the scope and spirit of the following claims.

The invention claimed is:

1. A dummy teat including a nipple carrier and a hollow dummy nipple projecting from said nipple carrier, said dummy nipple being oval in cross section in at least in one axial portion, said cross section having areas smaller in wall thickness on at least two opposed longitudinal sides which are crossed by a large axis of the oval of the cross-section of the dummy nipple, and wherein the areas of smaller wall thickness of each side are defined by an external radius of curvature and an internal corner, each said internal corner comprising a pair of interior straight line segments that are angled relative to the large axis of said oval cross-section, said line segments intersecting with one another at one end at the large axis.

2. The dummy teat according to claim 1, wherein the nipple carrier is at least one of a mouthpiece and mouth shield.

3. The dummy teat according to claim 1, wherein the dummy nipple, in the areas of a smaller wall thickness, has contours stretching in parallel in the cross-section inside and cross-section outside and, furthermore, has areas of a wall thickness which is larger or becomes larger with an increasing distance from the areas smaller in wall thickness.

4. The dummy teat according to claim 1, wherein the dummy nipple, in areas of a larger wall thickness, has at least one projection within the cross-section outside.

5. The dummy teat according to claim 1, wherein the dummy nipple includes at least one projection within the dummy nipple's cross-section inside, in areas of a larger wall thickness.

6. The dummy teat according to claim 1, wherein the dummy nipple has projections offset from each other within the dummy nipple's cross-section inside, on sides opposite each other.

7. The dummy teat according to claim 2, wherein at least one of the dummy nipple, the mouth piece, and the mouth shield include configuration features by which a preferred rotational position is predetermined in the mouth.

8. The dummy teat according to claim 7, wherein the opposed longitudinal sides having areas of a smaller wall thickness are arranged with regard to said further configuration features such as to be part of a transversal plane inside a baby's mouth when in use in a preferred orientation.

9. The dummy teat according to claim 1, wherein more areas of a smaller wall thickness are disposed symmetrically to the small axis and/or large axis of the oval between the large axis and the small axis of the oval, externally limiting the cross-section outside of the dummy nipple.

10. The dummy teat according to claim 1, wherein the areas of a larger wall thickness are disposed on the two opposed longitudinal sides of the dummy nipple which, when in use, are engaged by a frontal plane of the mouth.

11. The dummy teat according to claim 10, wherein the areas of a larger wall thickness are disposed on at least one of the two longitudinal sides on the small axis and symmetrically on either side of the small axis of an oval externally limiting the cross-section of the dummy nipple.

12. The dummy teat according to claim 1, wherein said dummy nipple has a hollow nipple shank and a hollow nipple head and wherein the areas having a larger wall thickness are extended in at least one of a longitudinal direction of the hollow nipple shank and the hollow nipple head at least across one portion of the at least one of the nipple shank and nipple head, and the areas having a smaller wall thickness are extended in a longitudinal direction of the nipple head at least across one portion of the nipple head.

13. The dummy teat according to claim 12, wherein at least one of the areas of a smaller wall thickness and the areas of a larger wall thickness extend substantially over the full length of the nipple shank.

14. The dummy teat according to claim 12, wherein the portions of a smaller wall thickness and/or the portions of a larger wall thickness extend substantially over the full length of the hollow nipple head.

15. The dummy teat according to claim 14, wherein at least one of the dummy nipple and the mouthpiece are manufactured from at least one of the group consisting of latex, silicone, polyisoprene, and cross-linked or thermoplastic elastomers.

16. The dummy teat according to claim 2, wherein the mouth shield is manufactured from one of a thermoplastic material and cross-linked or thermoplastic elastomers.

* * * * *